US008556095B1

(12) United States Patent
Yamaguchi

(10) Patent No.: US 8,556,095 B1
(45) Date of Patent: Oct. 15, 2013

(54) THREADED BOTTLE CAP HAVING MAGNETICALLY DETACHABLE DECORATION

(76) Inventor: Sawako Yamaguchi, New York, NY (US)

( * ) Notice: Subject to any disclaimer, the term of this patent is extended or adjusted under 35 U.S.C. 154(b) by 122 days.

(21) Appl. No.: 13/200,960

(22) Filed: Oct. 6, 2011

(51) Int. Cl.
*B65D 41/04* (2006.01)

(52) U.S. Cl.
USPC ..... 215/228; 215/230; 215/400; 220/230; 220/62.14; 220/890; 446/71; 446/75; 446/77; 446/129; 446/132; 446/137; 63/33; 63/900

(58) Field of Classification Search
USPC ..... 215/228, 230, 400; 220/62.14, 230, 220/483, 890; 446/129, 132, 71–77; 63/33, 63/900
See application file for complete search history.

(56) References Cited

U.S. PATENT DOCUMENTS

| | | | | |
|---|---|---|---|---|
| 2,672,257 | A * | 3/1954 | Simmonds | 220/230 |
| 3,961,721 | A * | 6/1976 | Gordon et al. | 220/230 |
| 4,060,100 | A * | 11/1977 | Miller et al. | 138/89 |
| 4,287,995 | A * | 9/1981 | Moriya | 215/228 |
| 4,583,651 | A * | 4/1986 | Ostberg | 215/228 |
| 4,601,403 | A * | 7/1986 | Pollitz | 215/228 |
| 5,176,269 | A * | 1/1993 | Herman | 215/228 |
| 5,390,510 | A | 2/1995 | Tirio-Cloonan | |
| 5,624,410 | A * | 4/1997 | Tsukada et al. | 604/256 |
| 5,625,347 | A * | 4/1997 | MacLean et al. | 340/568.1 |
| 5,860,297 | A | 1/1999 | Masucci | |
| 6,158,157 | A | 12/2000 | Hiscock | |
| 6,390,319 | B1 * | 5/2002 | Yu | 220/230 |
| 6,493,453 | B1 | 12/2002 | Glendon | |
| 6,545,594 | B1 * | 4/2003 | Knight et al. | 340/384.7 |
| D495,255 | S | 8/2004 | Lewis | |
| 6,771,165 | B2 * | 8/2004 | Burg, II et al. | 340/384.1 |
| 6,857,755 | B1 | 2/2005 | Lewis | |
| 7,189,134 | B2 * | 3/2007 | Nugent et al. | 446/74 |
| 7,950,541 | B2 * | 5/2011 | Holcomb et al. | 220/203.21 |
| 8,333,289 | B2 * | 12/2012 | Lopez et al. | 215/228 |
| 2002/0079281 | A1 * | 6/2002 | Hierzer et al. | 215/230 |
| 2003/0189494 | A1 * | 10/2003 | Lin | 340/686.1 |
| 2005/0035080 | A1 * | 2/2005 | Romero | 215/228 |
| 2006/0213862 | A1 * | 9/2006 | Smith | 215/228 |
| 2007/0241106 | A1 * | 10/2007 | Deg | 220/230 |
| 2009/0184121 | A1 * | 7/2009 | Hulin | 220/230 |
| 2009/0282869 | A1 | 11/2009 | Collison | |
| 2010/0078541 | A1 | 4/2010 | Faithi et al. | |
| 2010/0129144 | A1 | 5/2010 | Osborne | |
| 2012/0223044 | A1 * | 9/2012 | Scott et al. | 215/44 |

* cited by examiner

*Primary Examiner* — J. Gregory Pickett
*Assistant Examiner* — Ned A Walker
(74) *Attorney, Agent, or Firm* — James A. Quinton

(57) ABSTRACT

The replacement bottle cap according has a circular lid. An annular skirt extends downward from the lid to provide an opening for receipt of a threaded neck of a bottle. The skirt has internal threads to engage corresponding threads on an external portion of the neck of a bottle. The lid is permeable to a magnetic field.

A magnet is located in the cylindrical opening adjacent the lid. A decorative object extends upwardly from the lid. A decorative object is attracted to the magnet so the object is securely held to the lid. The decorative object is detachable from the lid by pulling on the object sufficiently to overcome the force exerted by the magnet on the object. At least a first connector extends from the outside of the skirt for receipt of a mating connector.

5 Claims, 3 Drawing Sheets

THREADED BOTTLE CAP HAVING MAGNETICALLY DETACHABLE DECORATION

FIELD OF THE INVENTION

The field of the invention is bottle caps and in particular decorative replacement bottle caps and jewelry relating thereto.

BACKGROUND OF THE INVENTION

The practice among consumers is to carry beverage bottles particularly water bottles as they travel. Often the beverage container is that of a popular brand. Such containers are often put down during exercise or work which can result in confusion over ownership of the bottle This can result in mixing up the containers which can be unsanitary when the containers have been opened prior to any mix up. Thus, there is a need for a replacement bottle cap that can be used to attractively individualize a beverage container. Bottle caps have been used as a raw material in the fabrication of jewelry. See U.S. Pat. No. 5,860,297. Illuminated bottled caps having magnets for mounting the caps to clothing are known. See U.S. Pat. No. 6,857,755. Beer bottle caps have been used as decoration for bar walls. See U.S. Pat. No. 6,158,157. There is still a need for a decorative replacement bottle cap that can personalized drink containers.

SUMMARY OF THE INVENTION

According to the invention, a replacement bottle cap for use on beverage containers is provided. In our modern society, many people travel from place to place with their own beverage container. Many such containers are provided by a few major brands. As a result, the beverage containers are relatively nondescript. Thus you can see many of the people at the gym or a park with the same containers that are impossible to distinguish. According to the invention a replacement bottle cap that can be personalized is provided. The replacement bottle cap can also be used as adornment for example as jewelry when not in use.

The replacement bottle cap according to the invention has a circular lid. An annular skirt extends downward from the lid to provide a cylindrical opening for receipt of a threaded neck of a bottle. The skirt has internal threads to engage corresponding threads on an external portion of the neck of a bottle. The lid is permeable to a magnetic field.

A magnet is located in the cylindrical opening adjacent the lid. The magnet supplies a magnetic field above and below the lid. A decorative object extends upwardly from the lid. The decorative object is at least partially ferromagnetic. The decorative object is attracted to the magnet so the object is securely held to the lid. The decorative object is detachable from the lid by pulling on the object sufficiently to overcome the force exerted by the magnet on the object. A first connector extends from the outside of the skirt for receipt of a mating connector e.g. a cable. The decorative object can be placed in the cylindrical opening when it is detached from the lid and when the cap is detached from a bottle where it is attracted by the magnet toward the lid for convenient storage when the cap is not in use.

In another aspect of the invention, a piece of jewelry or other decorative article made from the bottle caps according to the invention is provided. The jewelry includes one or more bottle cap having a circular lid and an annular skirt downwardly extending from the lid to define a cylindrical opening for receipt of a threaded bottle neck. The internal threads of the skirt engage corresponding threads on the neck of a bottle. The lid is permeable to a magnetic field. A magnet is located in the cylindrical opening adjacent the lid. The magnet supplies a magnetic field above and below the lid. A decorative object that is at least partially ferromagnetic is mounted in the cylindrical opening below the lid when the cap is not attached to the bottle. The decorative object is attracted by the magnet toward the lid to securely hold the object within the cap. A connector extends from the outside of said skirt for interaction with a mating connector. Thus the cap with the decorative object can be worn as jewelry.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
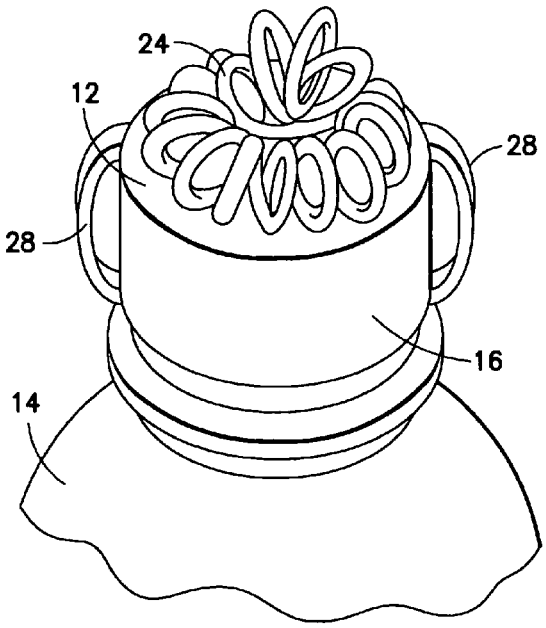
FIG. 1 is a perspective view of a replacement bottle cap according to the invention in use on a bottle.
Figure 2:
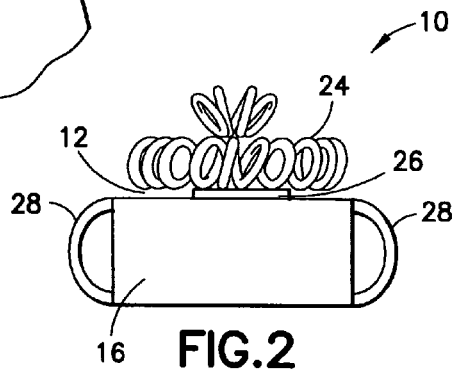
FIG. 2 is a side view of the cap of FIG. 1.
Figure 3:
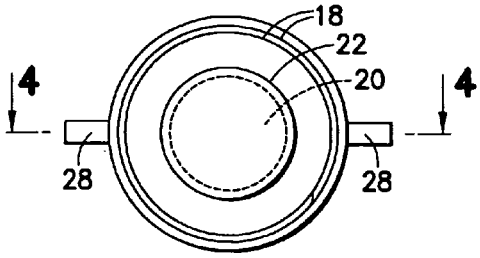
FIG. 3 is a bottom view of the cap of FIG. 1.
Figure 4:
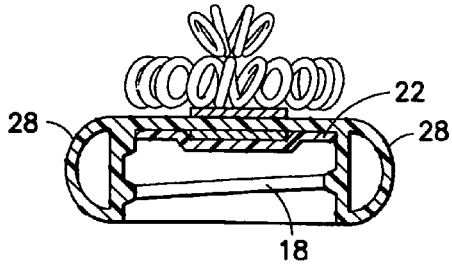
FIG. 4 is a sectional view through 4-4 of FIG. 3.

According to the invention, a replacement bottle cap for use on beverage containers is provided. Commercial beverages are often supplied by a few major brands. As a result, the popular beverage containers are common and relatively nondescript. You can see many people traveling through the city holding the same containers that are impossible to distinguish. According to the invention a replacement bottle cap that can personalize the container is provided. The replacement bottle cap can also be used as adornment for other goods such as pet products or the like. In another aspect or the invention, the caps can be used as jewelry when not in use on a container.

According to the invention, the replacement bottle cap preferably made of plastic having a circular lid is provided. An annular skirt extends downward from the lid to provide a cylindrical opening for receipt of a threaded neck of a bottle. The skirt has internal threads to engage corresponding threads on an external portion of the neck of a bottle. The lid is permeable to a magnetic field. A magnet is located in the cylindrical opening adjacent to the lid. Preferably the magnet abuts the lid. Desirably the magnet is affixed to the lid by any appropriate manner for example by gluing. Desirably the magnet has a protective shield preferably a water resistant preferably water proof coating or enclosure preferably plastic on and preferably surrounding the magnet to prevent contact with the liquid in the container. The magnet supplies a magnetic field above and below the lid. A decorative object extends upwardly from the lid. The decorative object is at least partially ferromagnetic preferably at its base. The decorative object is attracted to the magnet so the object is securely held to the lid. The decorative object is detachable from the lid by pulling on the object sufficiently to overcome the force exerted by the magnet on the object. A first connector preferably a loop extends from the outside of the skirt for receipt of a mating connector preferably a cable. Desirably, a second connector preferably a loop extends from the outside of the skirt for receipt of a mating connector preferably a cable. Preferably, the second connector is located on the opposite side of the skirt from the first connector.

The decorative object preferably generally cylindrical optionally annular in shape has a smaller diameter than the cylindrical opening and can be placed in the cylindrical opening when it is detached from the lid and when the cap is detached from a bottle where it is attracted by the magnet toward the lid for convenient storage when the cap is not in use. Preferably the object is inserted into the cylindrical space base first.

In another aspect of the invention, a piece of jewelry or other decorative article made from at least in part the bottle caps according to the invention is provided. The jewelry includes one or more bottle caps having a circular lid and an annular skirt downwardly extending from the lid to define a cylindrical opening for receipt of the threaded neck of a bottle. The skirt has internal threads to engage corresponding threads on an external portion of the neck of a bottle. The lid is permeable to a magnetic field. A magnet is located in the cylindrical opening adjacent the lid preferably abutting the lid. The magnet supplies a magnetic field above and below the lid. A decorative object preferably annular shaped that is at least partially ferromagnetic is mounted in the cylindrical opening below the lid when the cap is not attached to the bottle. Desirably the decorative object has a decorated top and a ferromagnetic bottom. Desirably, the object has a metal ring attached to its bottom. The decorative object is attracted by the magnet toward the lid to securely hold the object within skirt of the cap and display the decoration. A first connector preferably a loop extends from the outside of the skirt for receipt of a cable or mounting ring. Desirably, a second connector preferably a loop preferably extends from the outside of the skirt for receipt of the cable or mounting ring. Preferably, the second connector preferably a loop is located on the opposite side of the skirt from the first connector.

The decorative object has a smaller diameter than the cylindrical opening and can be placed in the cylindrical opening when it is detached from the lid and when the cap is detached from a bottle. It is attracted at its bottom by the magnet and attracted toward the lid for convenient storage when the cap is not in use. Optionally the top of decorative object can extend beyond the bottom of the skirt or be contained within the skirt. The decorative top of the decorative object can be of various designs, artistic displays, or affiliation display i.e. team or school logos. Preferably a cable desirably a metal chain, rope cable or a plastic cable such as fishing line is strung through the first loop and preferably the second loop to form a necklace or bracelet. Optionally, a mounting ring such as a jump ring connects the cap to a necklace, bracelet or other piece of jewelry.

Figure 5:
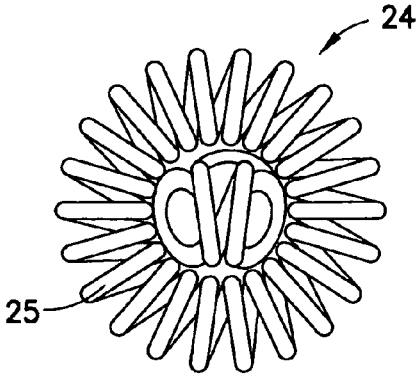
FIG. 5 is a top view of a decorative object according to the invention.
Figure 6:
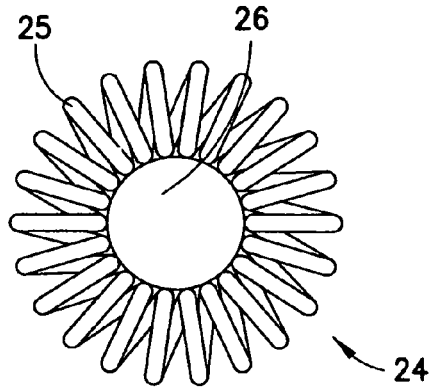
FIG. 6 is a bottom view of the decorative object according to the invention.

As best seen in FIGS. 1-4, a replacement bottle cap 10 preferably made of plastic having a circular lid 12 is provided. An annular skirt 16 extends downward from the lid 12 to provide a cylindrical space for receipt of a threaded neck of a bottle 14. The skirt 16 has internal threads 18 to engage corresponding threads on an external portion of the neck of a bottle 14. The lid 12 is permeable to a magnetic field. A magnet 20 is located in the cylindrical space adjacent to the lid 12 preferably abutting lid 12. Desirably the magnet 20 is affixed to the lid by any appropriate manner for example by gluing. Desirably the magnet has a protective shield preferably water resistant preferably a water proof coating or enclosure preferably plastic surrounding the magnet to prevent contact with the liquid in the container. Desirably, the plastic shield is molded over the magnet. Optionally a protective disk 22 can be fitted into the cap to provide a water tight compartment for the magnet 20 in the replacement cap 10 The magnet supplies a magnetic field above and below the lid. A decorative object 24 extends upwardly from the lid. As best seen in FIGS. 5 and 6, the decorative object 24 is at least partially ferromagnetic preferably at its base. Desirably the decorative object 24 has a metal ring or metal disk 26 attached to the bottom and a plastic top display portion. The decorative object 24 is attracted to the magnet 20 so the object is securely held to the lid. The decorative object 24 can be any pleasing desired display, design, artistic displays, or affiliation display i.e. team or school logos. The decorative object 24 is detachable from the lid 12 by pulling on the object 24 sufficiently to overcome the force exerted by the magnet on the object. A first connector preferably a loop 28 extends from the outside of the skirt for receipt of further connector preferably a cable. Desirably, a second connector preferably a loop 28 extends from the outside of the skirt for receipt of a further connector preferably a cable. Preferably, the connectors 28 are located on opposite sides of the skirt 16 from one another.

Figure 7:
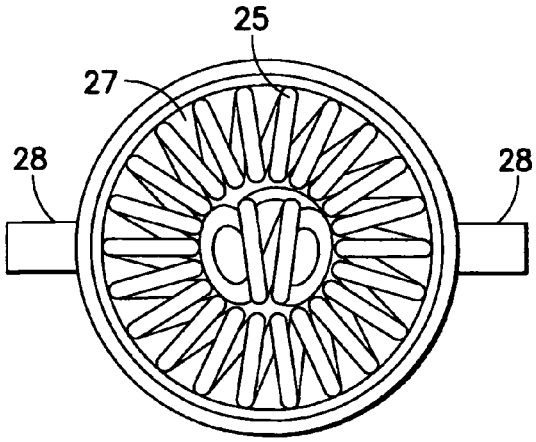
FIG. 7 is a bottom view of the replacement cap according to the invention with the decorative object inside the cap.

As best seen in FIG. 7, the decorative object 24 is preferably generally cylindrical optionally annular in shape. It has a smaller diameter than the cylindrical opening 27 in the cap 10 and can be placed in the cylindrical opening 27 when it is detached from the lid and when the cap is detached from a bottle 14 where it is attracted by the magnet 20 toward the lid 12 for convenient storage when the cap is not in use.

Figure 8:
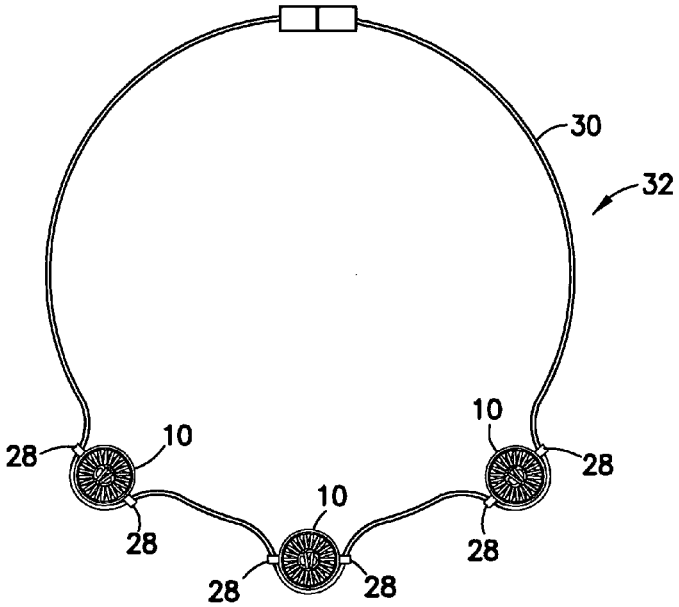
FIG. 8 is a plan view of a necklace according to the invention.
Figure 9:
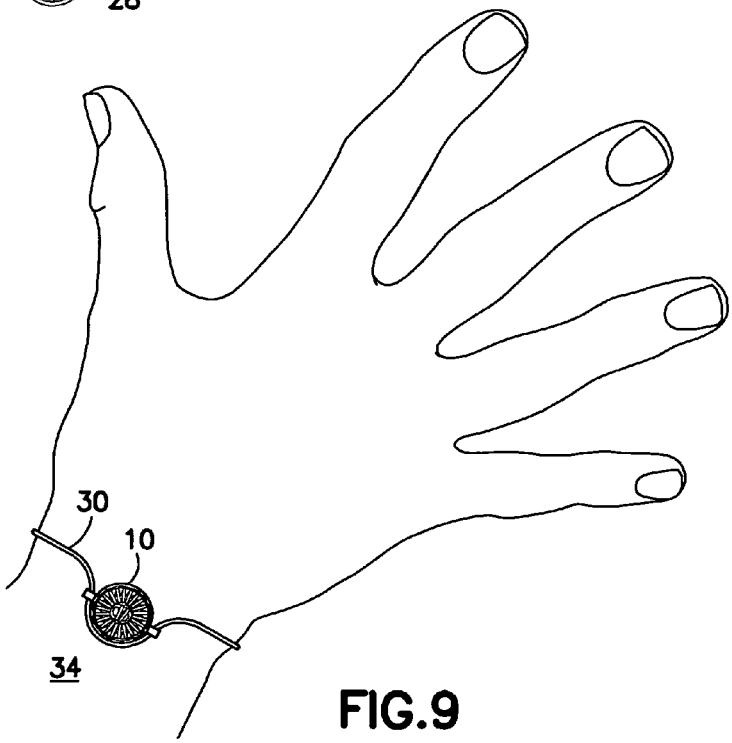
FIG. 9 is a plan view of a bracelet according to the invention in use.

In another aspect of the invention, as best seen in FIGS. 8 and 9, a piece of jewelry or other decorative article made from at least in part the bottle caps according to the invention is provided. The decorative object is inserted into the cylindrical opening in the bottle cap. The jewelry includes one or more bottle caps having a circular lid 12 and an annular skirt 16 downwardly extending from the lid 12 to define a cylindrical opening 27 for receipt of the threaded neck of a bottle. The skirt 16 has internal threads 18 to engage corresponding threads on an external portion of the neck of a bottle. The lid 12 is permeable to a magnetic field. A magnet 20 is located in the cylindrical opening adjacent the lid preferably abutting the lid 12. The magnet supplies a magnetic field above and below the lid. A decorative object preferably cylindrically shaped that is at least partially ferromagnetic is mounted in the cylindrical opening 27 below the lid 12 when the cap is not attached to the bottle. Desirably the decorative object 24 has a decorated plastic top 25 and a ferromagnetic bottom 26. The decorative object is attracted by the magnet 20 toward the lid 12 to securely hold the object 24 within skirt of the cap and display the decoration. A first connector preferably a loop 28 extends from the outside of the skirt for receipt of a cable or mounting ring. Desirably, a second connector preferably a loop 28 preferably extends from the outside of the skirt 16 for receipt of the cable or mounting ring. Preferably, the second connector preferably a loop is located on the opposite side of the skirt from the first connector.

The decorative object 24 has a smaller diameter than the cylindrical opening 27 and can be placed in the cylindrical opening 27 when it is detached from the lid 12 and when the cap is detached from a bottle where it is attracted by the magnet 20 toward the lid for convenient storage when the cap is not in use. Optionally the top of decorative object can extend beyond the bottom of the skirt 16 or be contained within the skirt. The decorative top of the decorative object can be of various designs, artistic displays, or affiliation display i.e. team or school logos. Preferably a cable desirably a metal chain, rope cable or a plastic cable 30 such as fishing line is strung through the loops 28 to form a necklace 32 or bracelet 34. Optionally, a mounting ring such as a jump ring connects the cap to a necklace, bracelet or other piece of jewelry.

The foregoing is considered as illustrative only to the principals of the invention. Further, since numerous changes and modification will occur to those skilled in the art, it is not desired to limit the invention to the exact construction and operation shown and described above, and accordingly, all suitable modifications and equivalents may be resorted to, falling within the scope of the invention.

The invention claimed is:

1. A bottle cap for closing a bottle comprising:

a cap body comprising:

a circular closed top lid permeable to a magnetic field and having an upper surface and a lower surface;

an annular skirt downwardly extending from said top lid; said annular skirt and said top lid defining a cylindrical recess for receiving a neck of said bottle; said annular skirt having:

an exterior surface;

internal threads for engaging external threads on said neck of said bottle;

a first connecting loop outwardly extending from said exterior surface for receipt of a first mating connector;

a second connecting loop outwardly extending from said exterior surface for receipt of a second mating connector; said second connecting loop disposed opposite said first connecting loop;

a magnet contained in a waterproof enclosure located adjacent said lower surface of said top lid in an upper portion of said cylindrical recess; said magnet generating a magnetic field above and below said lid;

a decorative object extending upwardly from said top lid; said decorative object having a decorative top and a ferromagnetic bottom magnetically secured to said upper surface of said top lid; said decorative object being detachable from said top lid; and, when said cap body is detached from said bottle, said decorative object is capable of being magnetically secured to said lower surface of said top lid and stored within said cylindrical recess.

2. The bottle cap according to claim 1, wherein said magnet abuts said top lid.

3. The bottle cap according to claim 1, wherein said decorative object is generally cylindrical in shape.

4. The bottle cap according to claim 1, wherein said first connecting loop and said second connecting loop are cables.

5. The bottle cap according to claim 4, wherein said cables are cylindrical.

* * * * *